US006030295A

United States Patent [19]

Takeda

[11] Patent Number: 6,030,295

[45] **Date of Patent: *Feb. 29, 2000**

[54] GOLF CLUB

[75] Inventor: Hitoshi Takeda, Tsubame, Japan

[73] Assignee: Kabushiki Kaisha Endo Seisakusho, Niigata, Japan

[ * ] Notice: This patent is subject to a terminal disclaimer.

[21] Appl. No.: 09/113,957

[22] Filed: Jul. 10, 1998

[30] Foreign Application Priority Data

Nov. 20, 1997 [JP] Japan ..... 9-319819

[51] Int. Cl.[7] ..... A63B 53/04

[52] U.S. Cl. ..... 473/345; 473/350; 473/335

[58] Field of Search ..... 473/345, 346, 473/349, 350, 330, 331, 332, 334, 335, 336, 337, 338, 339

[56] References Cited

U.S. PATENT DOCUMENTS

| | | |
|---|---|---|
| 4,852,880 | 8/1989 | Kobayashi . |
| 4,883,274 | 11/1989 | Hsien . |
| 4,964,640 | 10/1990 | Nakanishi . |
| 5,184,823 | 2/1993 | Desbiolles . |
| 5,207,427 | 5/1993 | Saeki . |
| 5,346,216 | 9/1994 | Aizawa . |
| 5,421,577 | 6/1995 | Kobayashi . |
| 5,465,968 | 11/1995 | Aizawa . |
| 5,522,593 | 6/1996 | Kobayashi . |
| 5,720,673 | 2/1998 | Anderson . |
| 5,807,189 | 9/1998 | Martin . |
| 5,899,820 | 5/1999 | Minematsu . |

FOREIGN PATENT DOCUMENTS

| | | |
|---|---|---|
| 60-97158 | 7/1985 | Japan . |
| 62-201168 | 9/1987 | Japan . |

*Primary Examiner*—Sebastiano Passaniti
*Attorney, Agent, or Firm*—Quarles & Brady LLP

[57] ABSTRACT

A cavity back type head golf club which can prevent distortion of the face at the time of striking the ball, and improve attractiveness. A cover 17 is fixed to a head body 16 having a cavity 18 on a rear side, to cover the rear face opening of the cavity 18. The method of fixing involves fixing by pressing. The cover 17 is pressed into a spot facing 21 of the head body 16, to give a dovetail joint. If the cavity 18 is made by machining, then even if machining marks remain, these cannot be seen.

10 Claims, 7 Drawing Sheets

GOLF CLUB

BACKGROUND OF THE INVENTION

1. Field of the Invention

The present invention relates to a golf club, and in particular to the construction of the head of an iron club.

2. Description of the Related Art

As a head for an iron club there is the so called cavity back type head. The cavity back type head is one where a cavity comprising a hollow portion is formed in the rear of a head body having a face, being the striking face, on the front thereof. In this way, the face can be widened without increasing the weight of the head body, and also the inertia moment of the head can be increased by distributing the weight to the peripheral portion away from the face, thus enabling further widening of the sweet area. That is to say, even when the ball is hit at a position away from the foot of a perpendicular line from the face to the center of gravity of the head, deflection of the head is minimal, thereby reducing mis-shots.

With the cavity back type head however, rigidity is poor compared to the so called muscle type head which has no cavity. There is thus the problem that the face is susceptible to distortion particularly when the ball is hit at a location away from the sweet spot, thus giving rise to deviation in the direction of flight of the ball. Furthermore there is the problem, particularly when the cavity is formed by machining, that cutter marks from the tool remain, impairing the attractiveness. Conventionally, in order to make the cutter marks less conspicuous, shot blasting is carried out, however there is a limit to this.

Furthermore, for example as disclosed in Japanese Unexamined Utility Model Publication No. 60-97158, in order to adjust the weight balance, a weight made from a denser material than that of the head body, is positioned inside the cavity of the head body. However, this results in limitations to the method of attachment and the design to ensure that the attractiveness is not impaired by the externally exposed weight, thus posing difficulties to the free selection of materials and balance adjustment. Furthermore, while for the materials which can be used for the weight itself, there are also those with poor corrosion resistance (for example copper or beryllium copper or tungsten) or with poor strength (for example lead), since low corrosion resistance and strength can also be the cause of a loss in attractiveness, then from this point also there is a limit to the material which can be used as the weight.

In Japanese Unexamined Patent Publication No. 62-201168, there is disclosed a head for an iron club where, in order to increase the natural frequency of the base surface portion of the head to extend the flight distance of a ball, a cover (weight) made of a denser material than that of the head body is provided on the rear portion of a head body having a cavity (hollow portion) to cover the cavity, the hollow portion thus being defined by the cover and the inner face of the cavity. With this head, the cover is secured to the head body by fitting the cover into a spot facing in the head body and then bonding. However, securing using bonding results in an unreliable attachment, so that due to impact or the like during use, the cover is likely to come off from the head body.

Welding has also been considered as a means for securing the cover to the head body. However, with welding, weld marks and pin holes remain, with a loss in attractiveness. Moreover, there is also the case where, due to the material for the head body and the cover, welding is not possible. Hence there is a limit to the selection of the material. Furthermore, in the case of plating, adherence of the plating may be compromised depending on the metal material.

SUMMARY OF THE INVENTION

The present invention addresses the above problems with golf clubs wherein a cover is provided on the rear face of a cavity back type head, with the object of improving the attractiveness and increasing the attachment strength between the head body and the cover.

In order to achieve the above objects, the invention according to a first aspect comprises a golf club incorporating a head having a shaft connected to one side and a face on a front, wherein the head comprises; a head body formed with a cavity comprising a hollow portion in a rear face, and a cover joined to a rear side of the head body by pressing so as to cover the rear face opening of the cavity.

Such a press operation gives a joint such that the head body and cover can be securely fixed. Moreover, limitations to the selection of materials for the head body and the cover are reduced. Furthermore, even in the case where a weight is disposed inside the cavity, since this is concealed from the outside, restrictions on the material and shape and attachment means for the weight are reduced. Moreover when being used, due to the stiffening effect of the cover, then even in the case where the ball is struck at a location away from the sweet spot, the face is unlikely to distort, so the flight of the ball is stable. Furthermore the joint strength between the head body and the cover is strong so that the cover is unlikely to come away from the head body due to impact at the time of striking the ball.

With the invention according to a second aspect, then with the golf club according to the first aspect, the cavity is formed by machining.

With the cavity formed in this way by machining, then even if cutter marks are left on the inside face of the cavity, since these are concealed from the outside, attractiveness is not impaired.

With the invention according to a third aspect, then with the golf club according to the first and second aspects, the density of the material for the cover is less than that of the material for the head body.

If the material for the cover is a low density material, then the effect of distributing the weight to the peripheral portion by having the cavity, is not compromised.

With the invention according to a fourth aspect, then with the golf club according to the first and second aspects, the cover and head body are made from the same material.

If the cover and head body are made from the same material, then for example when carrying out plating, the whole face can be plated, so that in the plating operation, laborious masking is not required.

DESCRIPTION OF THE PREFERRED EMBODIMENTS

Figure 1:
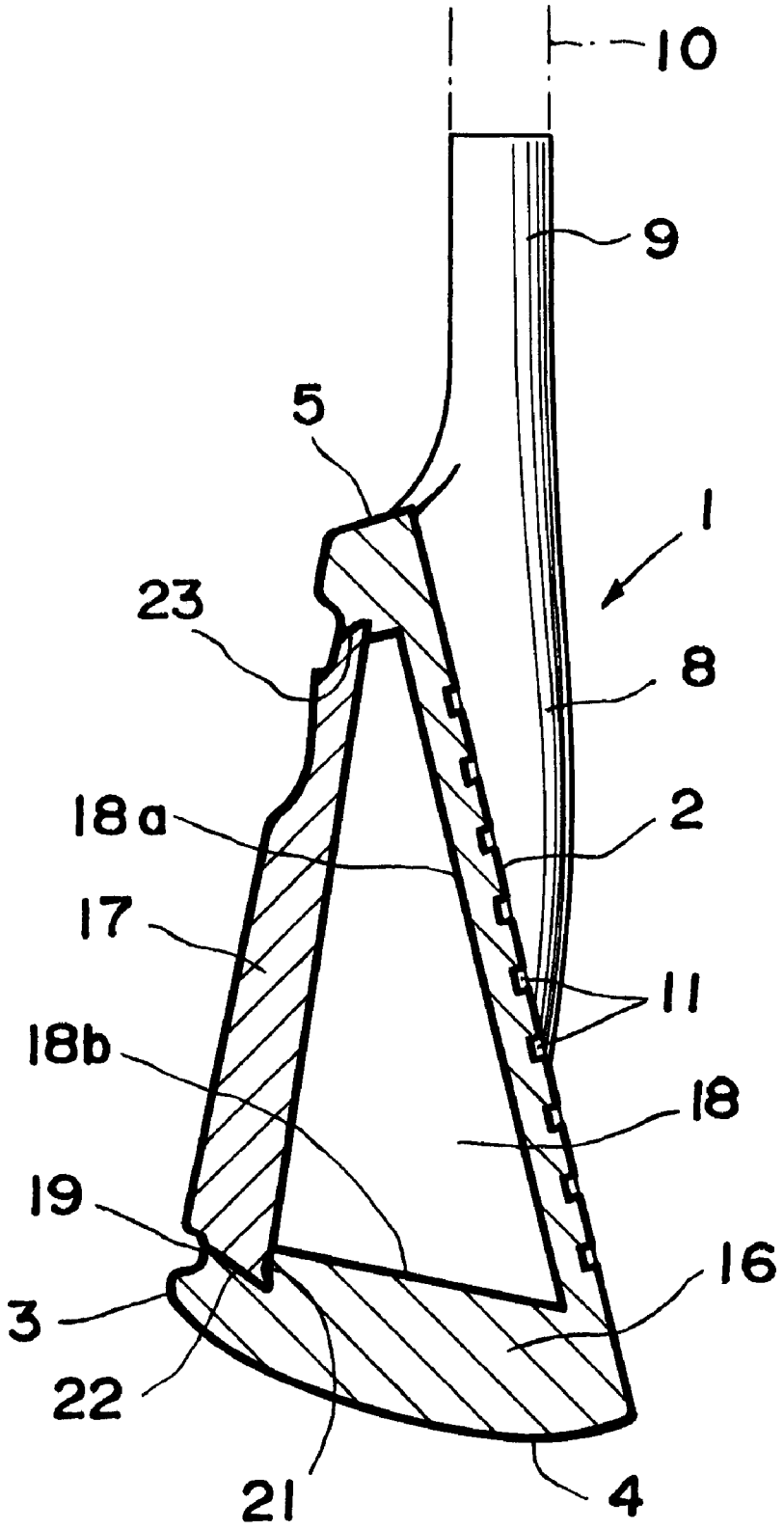
FIG. 1 is a cross sectional view showing a first embodiment of a golf club according to the present invention.
Figure 2:
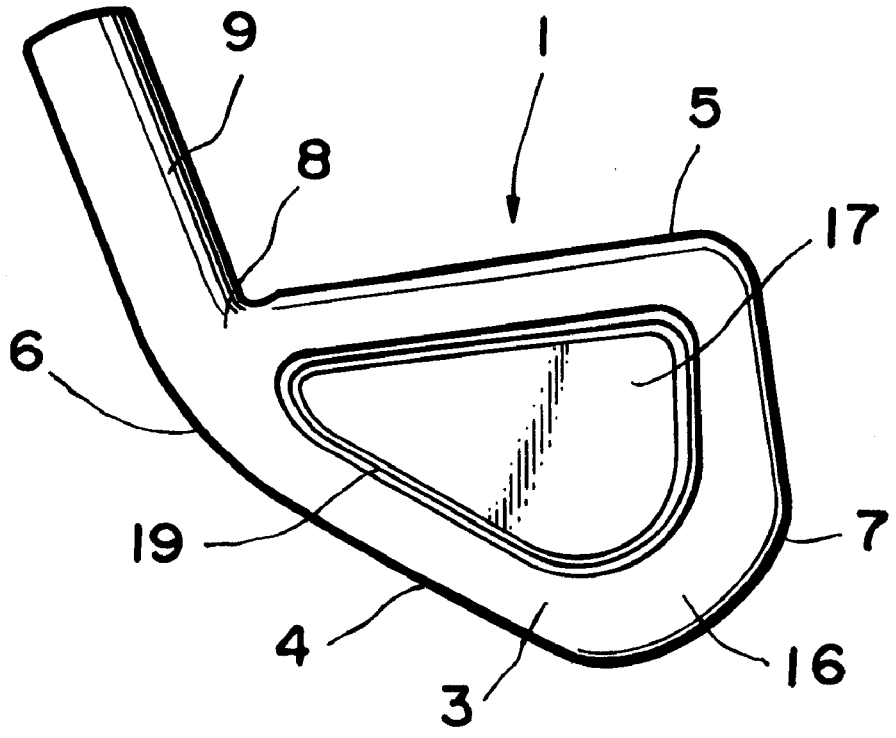
FIG. 2 is a perspective view of the golf club of FIG. 1.

As follows is a description of a first embodiment of a golf club of a present invention, with reference to FIG. 1 through FIG. 3. The golf club of this embodiment is an iron club. Numeral 1 indicates a metal golf club head. The head 1 has a front 2, a rear side back 3, a lower side sole 4, an upper side top 5, a heel 6 on one side in the left right direction (FIG. 2), and a toe 7 on the other side in the left right direction. A neck 8 is formed at the heel 6, and a hosel 9 is formed protruding upward from the neck 8. The hosel 9 constitutes a shaft connection portion for connecting to a shaft 10 (FIG. 1). The face 2 is formed with a plurality of approximately parallel grooves 11, referred to as score lines.

The head 1 comprises a head body 16 which constitutes portions other than the back 3 of the head 1, and a cover 17 fixed to a rear face of the head body 16. With this embodiment, the cover 17 is a substantially flat plate. The shape of the cover 17 however is not limited to this, and may be curved. Furthermore since the back 3 side, need not be as strong as the face 2 side, the thickness of the cover 17 can be around 1 mm or less than this. However it may be thicker than this. The material for the head body 16 is stainless steel while the material for the cover 17 is titanium or titanium alloy. Hence the density of the material for the cover 17 is less than that of the material for the head body 16. The materials for the head body 16 and the cover 17 however are not limited to these, and various types of material may be used. Moreover, the material for the head body 16 and for the cover 17 may be the same material such as steel. A cavity 18 comprising a hollow portion is formed in the back 3 side of the head body 16 such that the peripheral portions remain. The cover 17 covers the rear opening of the cavity 18. The rear face of the head body 16 and the rear face of the cover 17 are located in substantially the same plane. A groove 19 is formed in these rear faces, at the boundary of the head body 16 and the cover 17.

Formation of the cavity 18 will now be described. The head body 16 is basically formed by die forging involving one or a number of steps of cold forging or hot forging, while the cavity 18 is formed by machining. The die forging is carried out using a lower metal die and an upper metal die which are opened and closed relative to each other.

Figure 3:
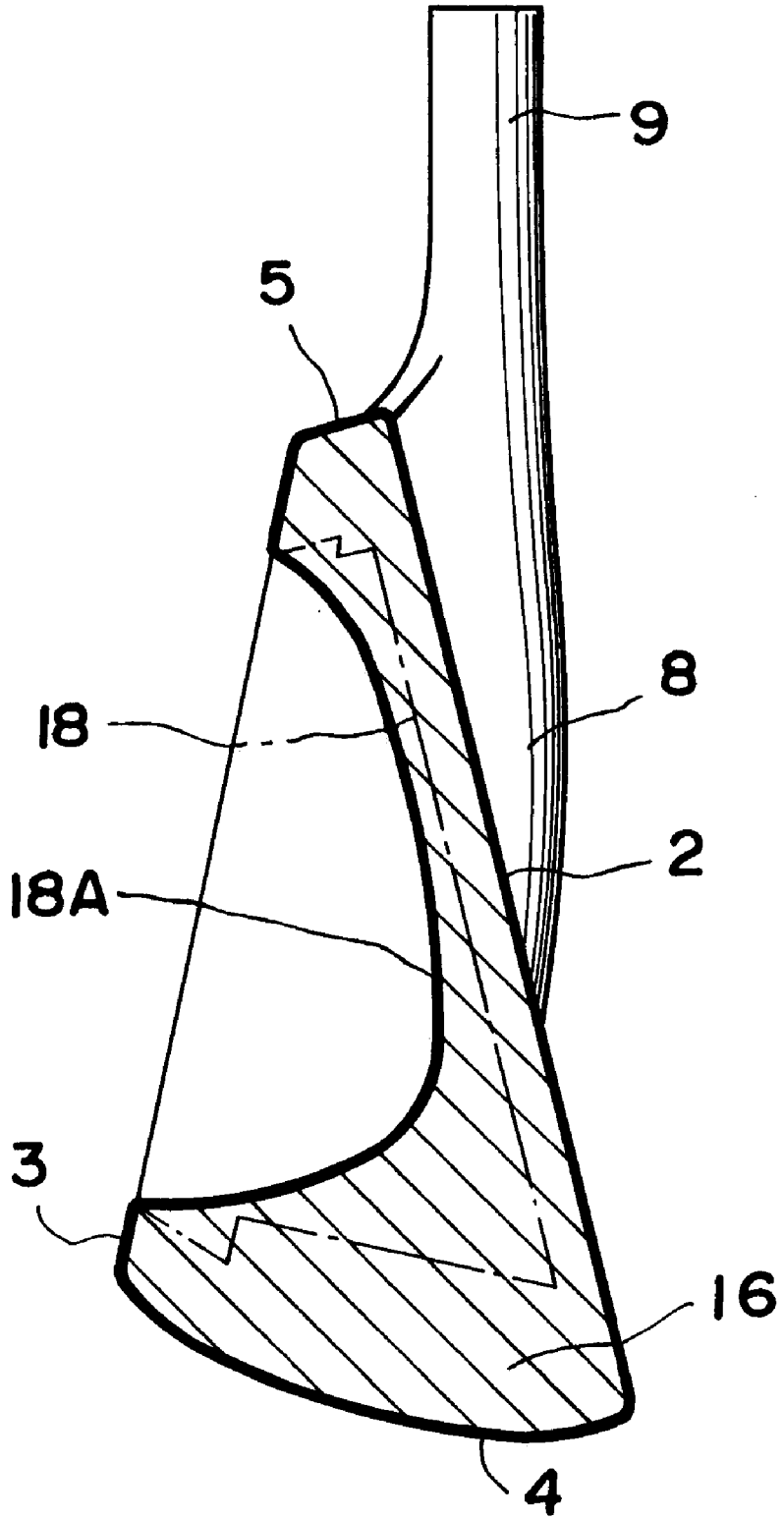
FIG. 3 is a cross-sectional view a head body prior to machining a cavity in the golf club of FIG. 1.

FIG. 3 shows the head body 16 after die forging and prior to machining. In this step, a hollow portion 18A which becomes the cavity 18, is formed in the back 3 side of the head body 16. This hollow portion 18A has an obtuse angle curved face, so that it does not have an undercut shape with respect to the opening/closing direction of the pair of metal dies used in the forging. After forging, the hollow portion 18A is machined deeper to form the cavity 18, using for example an end mill, that is to say a machine incorporating a cutting tool having a rotating shaft with a cutting edge on one end, and a spiral shape cutting edge on a side face. The final shape of the cavity 18 is an undercut shape (FIG. 1) with a front face 18*a* and a lower face 18*b* joined at an acute angle. The front face 18*a* of the cavity 18 is approximately parallel with the face 2, and the thickness of the head body 16 at this portion is approximately 2.5~3 mm.

The cover 17 is joined to the head body 16 by pressing. This means of joining will be described hereunder. On the back 3 side of the head body 16, a spot facing 21 is formed around the whole of the peripheral portion of the cavity 18. This is formed for example by machining. A peripheral side face 22 of the spot facing 21 has a spanwise dimension reducing towards the rear to give a reverse taper shape. On the other hand, a side face 23 on the periphery of the cover 17 has a taper face corresponding to the side face 22 of the spot facing 21, with the spanwise dimension slightly greater than that of the side face 22 of the spot facing 21.

The cover 17 is engaged inside the spot facing 21 of the head body 16, by pressing, for example with a press, so that due to the plastic deformation at the time of pressing, the side face 22 of the spot facing 21 and the side face 23 of the cover 17 are dovetailed together, thereby securely fixing the cover 17 to the head body 16.

Since the cover 17 is dovetailed in this way to the head body 16, the cover 17 can be reliably and securely fixed to the head body 16. Consequently, during use, there is no likelihood of the cover 17 coming away from the head body 16, due for example to the impact accompanying striking of the ball. In addition, since the rigidity of the head body 1 is increased due to the stiffening effect of the cover 17 fixed to the rear face of the head body 16 which has the cavity 18, then even in the case where the ball is struck at a location away from the sweet spot, the face is unlikely to distort so the flight of the ball is stable.

Furthermore since the rear face opening of the cavity 18 of the head body 16 is covered by the cover 17, the cavity 18 cannot be seen and hence the attractiveness of the head 1 is improved. Moreover, a head 1 with no cavity 18 gives the impression of a high class player model.

Additionally, with this embodiment, since the cavity 18 is formed by a combination of forging and machining, then a cavity 18 of a comparatively free shape, can be easily formed with a minimal number of steps and at a high yield. In other words, in the case of using the forging alone to form for example the front face 18*a* of the cavity 18 at an acute angle to the lower face 18*b* thereof, then the die-forging would be impossible due to the undercut shape of the cavity 18 relative to the die forging direction. On the other hand, in the case of forming the cavity 18 using the machining alone, then the machining quantity would be too much, resulting in a loss of the material.

A combination of forging and machining in accordance with embodiment of the invention, however, a complicated shape which is difficult to form by forging alone, can be formed at a high production yield, so that the front face 18*a* and the lower face 18*b* of the cavity 18 can be formed at an acute angle as with the present embodiment. In this way, the overall center of gravity of the head 1 can be moved towards the rear so that the center of gravity depth, that is, the distance between the face 2 and the center of gravity can be increased, thus enabling even further widening of the sweet spot area Regarding the finish, since the cavity 18 is formed by machining using an end mill, cutter marks remain on the inner face of the cavity 18. However these cutter marks are concealed by the cover 17 and are thus not seen, and hence the attractiveness of the head is not impaired. Furthermore, from a manufacturing point of view, there is no requirement for a post processing step such as shot blasting, to make the cutter marks less conspicuous.

Regarding the weight distribution, since apart from there being the cover 17, the interior of the head 1 is made hollow by the cavity 18, then the overall weight of the head 1 is distributed into the peripheral portion rather than the face, thus enabling an increase in the sweet spot area. Furthermore, with the present embodiment, since the density of the material for the cover 17 is less than that of the material for the head body 16, any reduction in the effect of the distributing the weight to the peripheral portion by having the cavity 18, can be minimized.

Moreover, since the cover 17 is joined to the head body 16 by pressing, then compared to the case with welding or the like, restrictions on the selection of the respective materials for the head body 16 and the cover 17 are minimal. Furthermore, there is no longer a problem with loss in attractiveness due to welding marks and pin holes which occurs in the case of welding.

With the first embodiment, the material for the head body 16 is stainless steel and the material for the cover 17 is titanium or a titanium alloy. However, for example, the material for the head body 16 and the cover 17 may be the same material such as a steel. If the head body 16 and the cover 17 are made from the same material, then when plating is carried out, for example to prevent corrosion, the whole surface can be plated, thus obviating the masking of portions which cannot be plated during the plating operation. In the case of a combination of a steel type material and a titanium type material, since the titanium type material is not plated, this part is masked prior to plating to prevent staining of the titanium type material, and a post plating operation to strip off the masking is then required.

Figure 4:
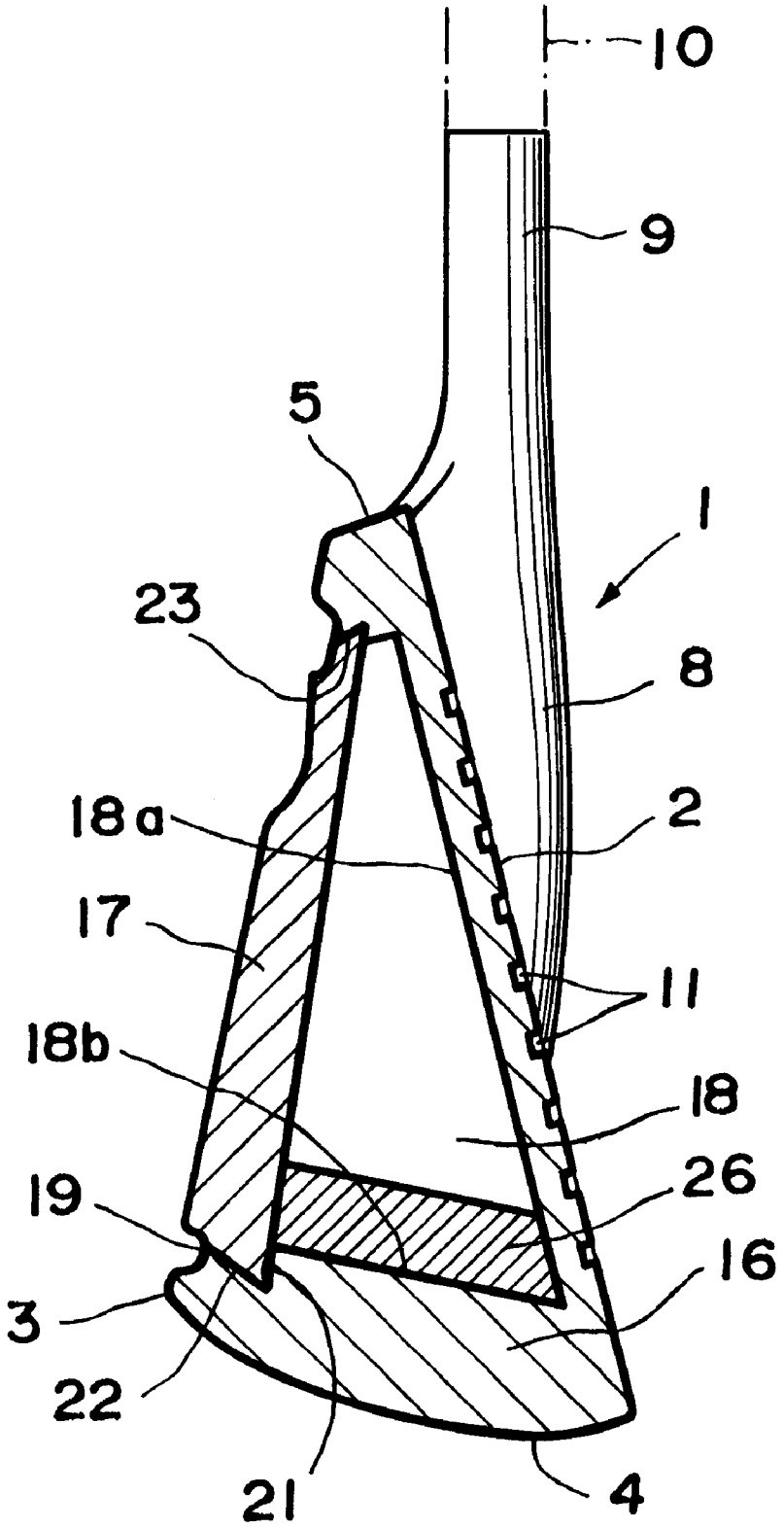
FIG. 4 is a cross-sectional view showing a second embodiment of a golf club according to the present invention.

FIG. 4 shows a second embodiment of a golf club according to the present invention. Parts corresponding to the golf club of the first embodiment are denoted by the same symbols and description is omitted. The head 1 of the golf club of the second embodiment is one where a weight 26 for adjusting the weight balance, is fixed to the head body 16 inside the cavity 18. The means to achieve this fixing may involve any appropriate means such as pressing using a press, welding, screwing, or clamping between the head body 16 and the cover 17.

In the case where, as with the second embodiment, a weight 26 is disposed inside the cavity 18, then since the rear face opening of the cavity 18 is covered by the cover 17, the weight 26 cannot be seen from the outside and hence the attractiveness is not impaired. Consequently, there is practically no limit to the material, the shape, and the fixing means for the weight 26. For example, for the material for the weight 26, a copper or beryllium copper or tungsten with poor corrosion resistance, or poor strength lead may be used without any problem.

Figure 5:
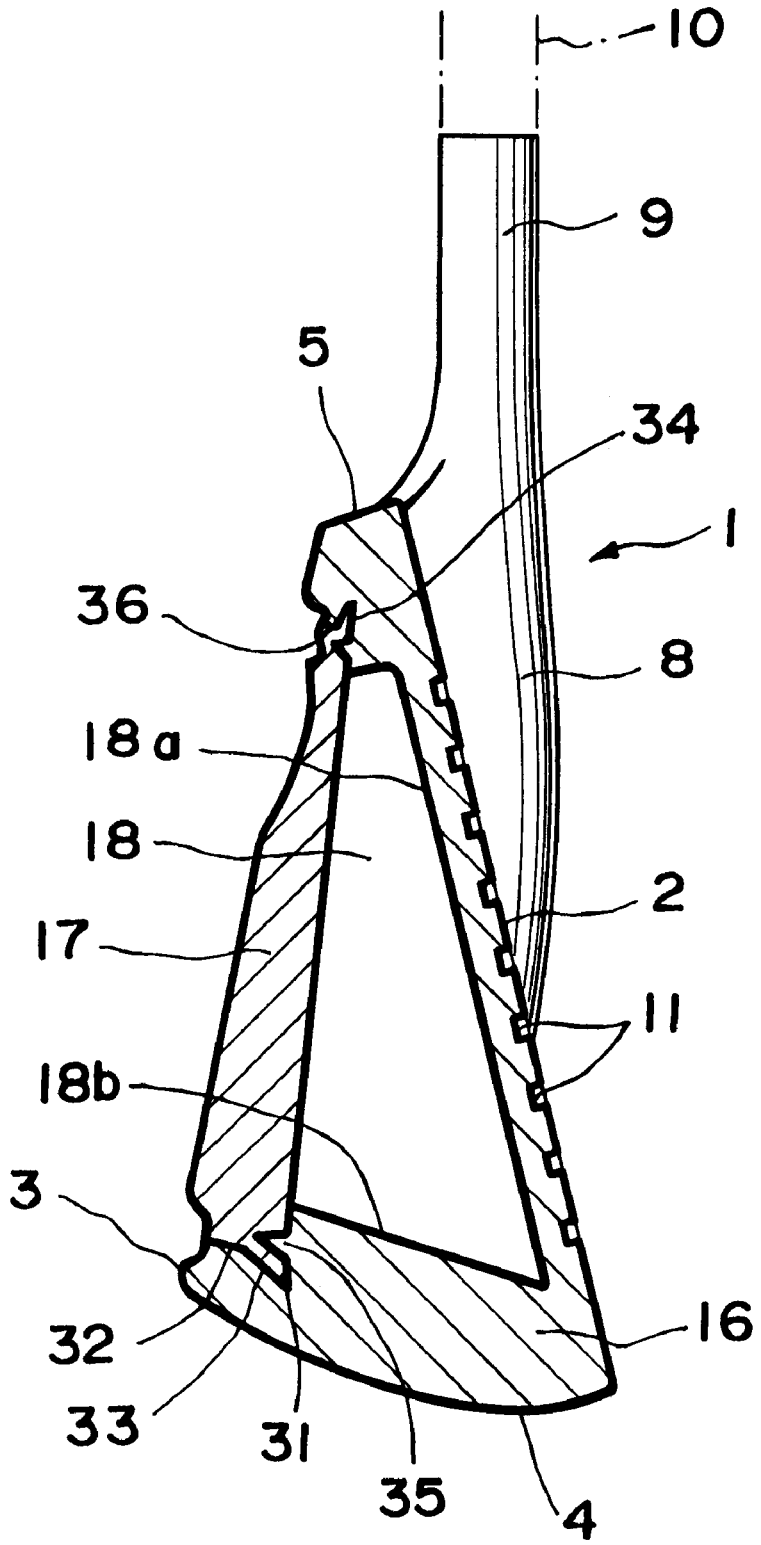
FIG. 5 is a cross-sectional view showing a third embodiment of a golf club according to the present invention.

FIG. 5 shows a third embodiment of a golf club according to the present invention. Parts corresponding to the golf club of the first embodiment are denoted by the same symbols and description is omitted. The third embodiment is an example of a modification to the fixing means between the head body 16 and the cover 17. In the third embodiment also, the cover 17 is joined to the head body 16 by pressing, and a spot facing 31 for pressure insertion of the cover 17 is formed on the back 3 side of the head body 16, around the whole of the peripheral portion of the cavity 18. With the side face of the spot facing 31 however, the rearward portion is an upright face 32, while the portion on the front side, that is the interior side has a spanwise dimension reducing towards the rear to give a reverse taper face 33. Furthermore, at a lower face 34, being the front face of the spot facing 31 is formed a sharp protrusion 35. The cover 17 is pressed into the spot facing 31 of the head body 16 using for example a press, and due to the plastic deformation at this time the protrusion 35 of the head body 16 cuts into the cover 17, and at the same time, the portion at the front of the side face 36 of the cover 17 is dovetailed into the reverse taper face 33 of the spot facing 31. As a result, the cover 17 is even more securely and reliably fixed to the head body 16.

Figure 6:
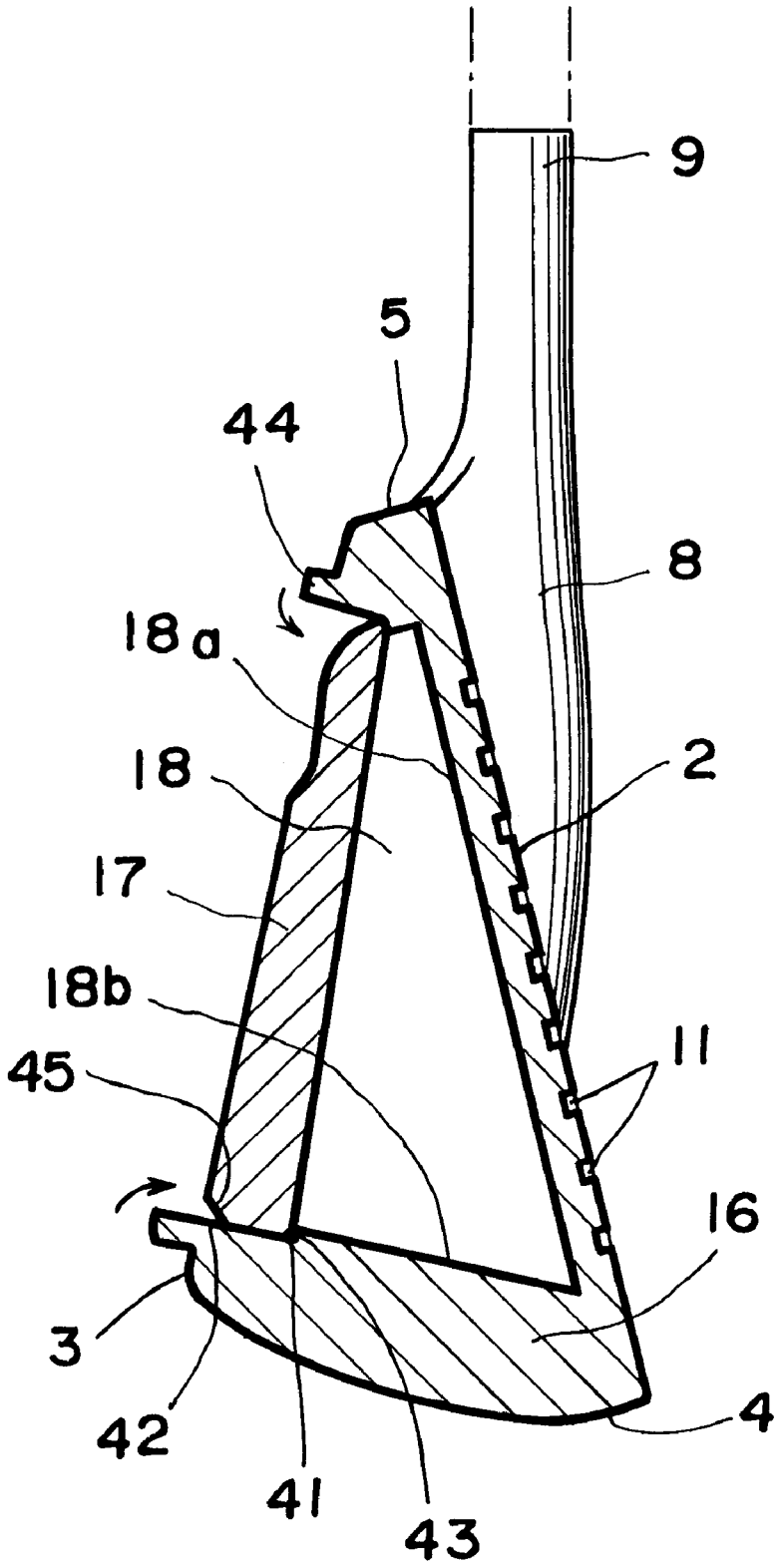
FIG. 6 is a cross-sectional view showing a fourth embodiment of a gold club according to the present invention, illustrating a condition prior to fixing the cover to the head body.
Figure 7:
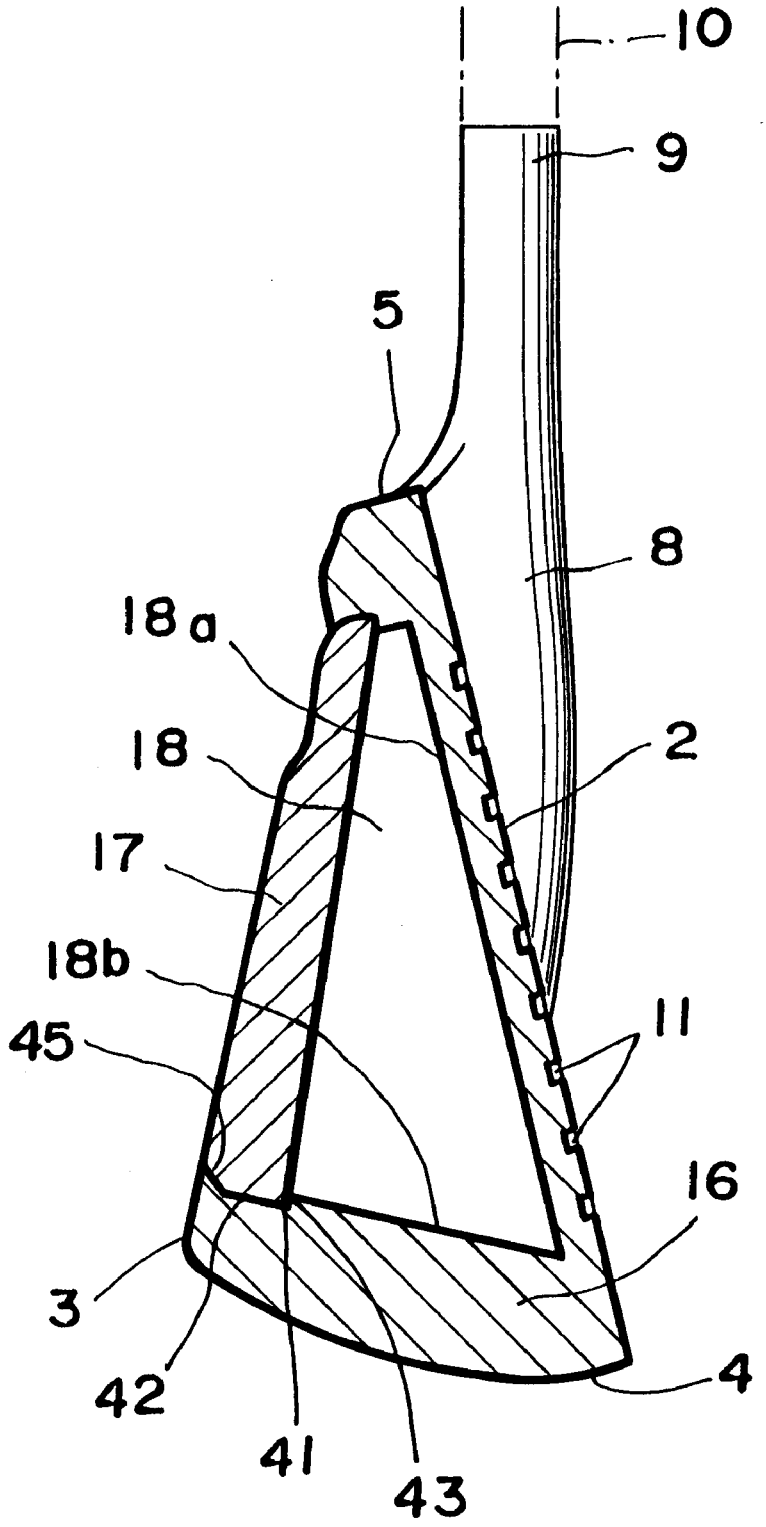
FIG. 7 is a cross-sectional view illustrating a condition after fixing the cover to the head body.

FIG. 6 and FIG. 7 show a fourth embodiment of a golf club according to the present invention. Parts corresponding to the golf club of the first embodiment are denoted by the same symbols and description is omitted. The fourth embodiment is an example of a modification to the fixing means between the head body 16 and the cover 17. In the fourth embodiment also, the cover 17 is joined to the head body 16 by pressing, and a spot facing 41 into which the cover 17 is fitted is formed on the back 3 side of the head body 16, around the whole of the peripheral portion of the cavity 18. Prior to joining the cover 17, as shown in FIG. 6, a side face 42 of the spot facing 41 is an upright face perpendicular to a bottom face 43 of the spot facing 41. Furthermore, a protruding portion 44 is formed at the peripheral portion of the spot facing 41, on the rear face of the head body 16. To suit this, the side face of the cover 17 is formed, at least on a rear side portion, with a taper face 45 having a spanwise dimension reducing towards the rear.

When fixing the cover 17 to the head body 16, the cover 17 is fitted inside the spot facing 41 of the head body 16, after which the protruding portion 44 of the head body 16 is plasticly deformed as shown by the arrow in FIG. 6 so that as shown in FIG. 7, the taper face 45 of the cover 17 is covered. In this way, the head body 16 and the cover 17 are dovetailed together so that the cover 17 is reliably and securely fixed to the head body 16. With the fourth embodiment, it is advantageous if the material for the cover 18, is more difficult to plasticly deform than that for the head body 16.

The present invention is not limited to the abovementioned embodiments, and various modified embodiments are possible. For example, with the beforementioned embodiments, the cavity 18 is formed by machining. However the cavity 18 may be manufactured by forging only, or by casting only. Moreover, the method of joining the cover to the head body by pressing is not limited to that described for the beforementioned respective embodiments, and various constructions are possible.

With the golf club according to the first aspect of the invention, the cover for covering the rear face opening of the cavity is joined to the rear side of the head body formed with a cavity comprising a hollow portion on the rear side, by pressing. Therefore the attachment strength between the head body and the cover can be increased and also limitations to the selection of materials for the head body and the cover are reduced. Furthermore, when being used, the face is unlikely to distort at the time of striking the ball so that as well as the flight of the ball being stable, due to the high attachment strength between the head body and the cover as mentioned before, the cover is unlikely to come away from the head body due for example to impact at the time of striking the ball. Moreover, due to the cover, the attractiveness is improved, and for example even in the case where a weight is disposed inside the cavity, restrictions on the material and shape and attachment means for the weight are reduced.

Furthermore, in the case, as with the golf club according to the second aspect of the invention where the cavity is formed by machining, then even though cutter marks may remain on the inner face of the cavity, these do not impair the attractiveness. Moreover from a manufacturing point of view, there is no requirement for post processing to make the cutter marks less conspicuous.

With the golf club according to the third aspect, in addition to the effects of the invention of the first and second aspects, since the density of the material for the cover is less than that of the material for the head body, the effect of distributing the weight to the peripheral portion by having the cavity, is not compromised.

With the golf club according the fourth aspect of the invention, in addition to the effects of the first and second aspects, since the cover and the head body are made from the same material, then for example when carrying out plating, the whole face can be plated, so that in the plating operation, laborious masking can be obviated.

What is claimed:

1. A golf club incorporating a head having a shaft connected to one side and a face on a front, wherein said head comprises:

a head body formed with a front face, a rear face, a cavity, and an opening through said rear face into said cavity, said cavity containing features to be concealed from view; and a metal cover completing the rear face and closing the opening into the cavity to conceal the features therein, at least one of said opening and said metal cover having a tapered surface around its periphery such that when said metal cover is pressed into position in the opening, the metal cover is seated in said opening against said tapered surface to secure the cover in place on the head body without the use of adhesives or other separate fasteners.

2. A golf club as claimed in claim 1, wherein said head body includes inner surfaces in said cavity which include cutter marks formed by machining.

3. A golf club as claimed in claim 2, wherein said cavity has an undercut shape with a front face and lower face thereof intersecting at an acute angle.

4. A golf club as claimed in claim 1, wherein said tapered surface includes a reverse taper spot facing which is formed in a peripheral portion of said cavity at the rear face of said head body, said spot facing being defined by a side face and a bottom face, and wherein a taper face corresponding to the side face of said spot facing is formed on a side face of the periphery of said cover, and said cover is pressed into said spot facing of said head body, to thereby join said cover to said head body.

5. A golf club as claimed in claim 4, wherein a sharp protrusion is formed on the bottom face of said spot facing, and said protrusion is cut into said cover.

6. A golf club as claimed in claim 1, wherein said head body forms a spot facing in a peripheral portion of said cavity at the rear face of said head body, and wherein said tapered surface includes a taper face which is formed on the side face of the periphery of said cover, and the spot facing of the head body is made to cover the taper face of said cover by plastic deformation of said head body, to thereby join said cover to said head body.

7. A golf club as claimed in claim 1, wherein a weight is fixed inside the cavity of said head body.

8. A golf club as claimed in claim 1, wherein the density of the material for said cover is less than that of the material for said head body.

9. A golf club as claimed in claim 1, wherein said cover and head body are made from a steel material.

10. A golf club as claimed as in claim 9, wherein a whole face of said head which is formed by said cover and said head body is plated with a metallic material.

* * * * *